United States Patent [19]

Brunner

[11] 3,964,541

[45] June 22, 1976

[54] APPARATUS FOR METAL CASTING

[75] Inventor: Donald G. Brunner, Waupaca, Wis.

[73] Assignee: The Budd Company, Troy, Mich.

[22] Filed: June 10, 1974

[21] Appl. No.: 478,014

[52] U.S. Cl. ..... 164/323; 425/450.1

[51] Int. Cl.² ..... B22D 5/04; B29C 3/02

[58] Field of Search ..... 164/324, 375, 323, 325, 164/137, 339, 342, 406, 311, 326–331; 425/452, 453, 454

[56] References Cited

UNITED STATES PATENTS

| | | | |
|---|---|---|---|
| 2,068,835 | 1/1937 | Wurster | 164/324 X |
| 2,154,967 | 4/1939 | Wurster | 164/324 |
| 3,103,705 | 9/1963 | Letica | 164/342 X |
| 3,255,866 | 6/1966 | Gulde | 425/452 X |
| 3,448,496 | 6/1969 | Arnold | 164/340 X |
| 3,523,997 | 8/1970 | Hennig | 425/453 X |
| 3,570,584 | 3/1971 | Powers | 164/406 X |
| 3,836,312 | 9/1974 | Derror | 425/454 X |

*Primary Examiner*—Francis S. Husar
*Assistant Examiner*—John S. Brown

[57] ABSTRACT

A method and the apparatus for casting molten metal into desired shapes utilizing a permanent metal mold for supporting a destructible mold liner which defines the final shape of the casting.

3 Claims, 6 Drawing Figures

APPARATUS FOR METAL CASTING

This invention relates to a method and apparatus for metal casting and more particularly to a method and apparatus utilizing a permanent molding fixture and a destructible liner nestible therein for receiving molten metal and holding the metal in the desired shape until solidified.

It is well known in the art to cast low melting alloys in iron molds by a method known as the permanent molding technique and higher melting alloys are cast in sand molds or ceramic molds which can withstand higher temperatures.

It is an object of this invention to provide a method for casting all metals by having a permanent iron mold supporting a removable sand or ceramic mold liner for receiving, shaping, and holding the molten metal until solidified and then being removable from the iron mold with the casting.

Another object of this invention is to provide a mechanical unit for handling the iron molds and sand liners through complete cycles of casting in a continuous cycling apparatus.

A further object of this invention is to provide a mechanical processing unit that positions the permanent iron molds for receiving the mold liners, assembles the mold by positioning the cope on the drag, passes the assembled mold to a pouring station and holds the assembly during the pour, maintains the mold in a closed position while the molten metal solidifies within the assembly, automatically separates the cope and drag, dumps the casting and liner from the mold, cleans the supporting surfaces of the cope and drag and returns the mold to the assembly position for receiving new mold liners for another cycle.

These and other objects of this invention will become obvious as reference is made to the following specification and drawing wherein.

Figure 1:
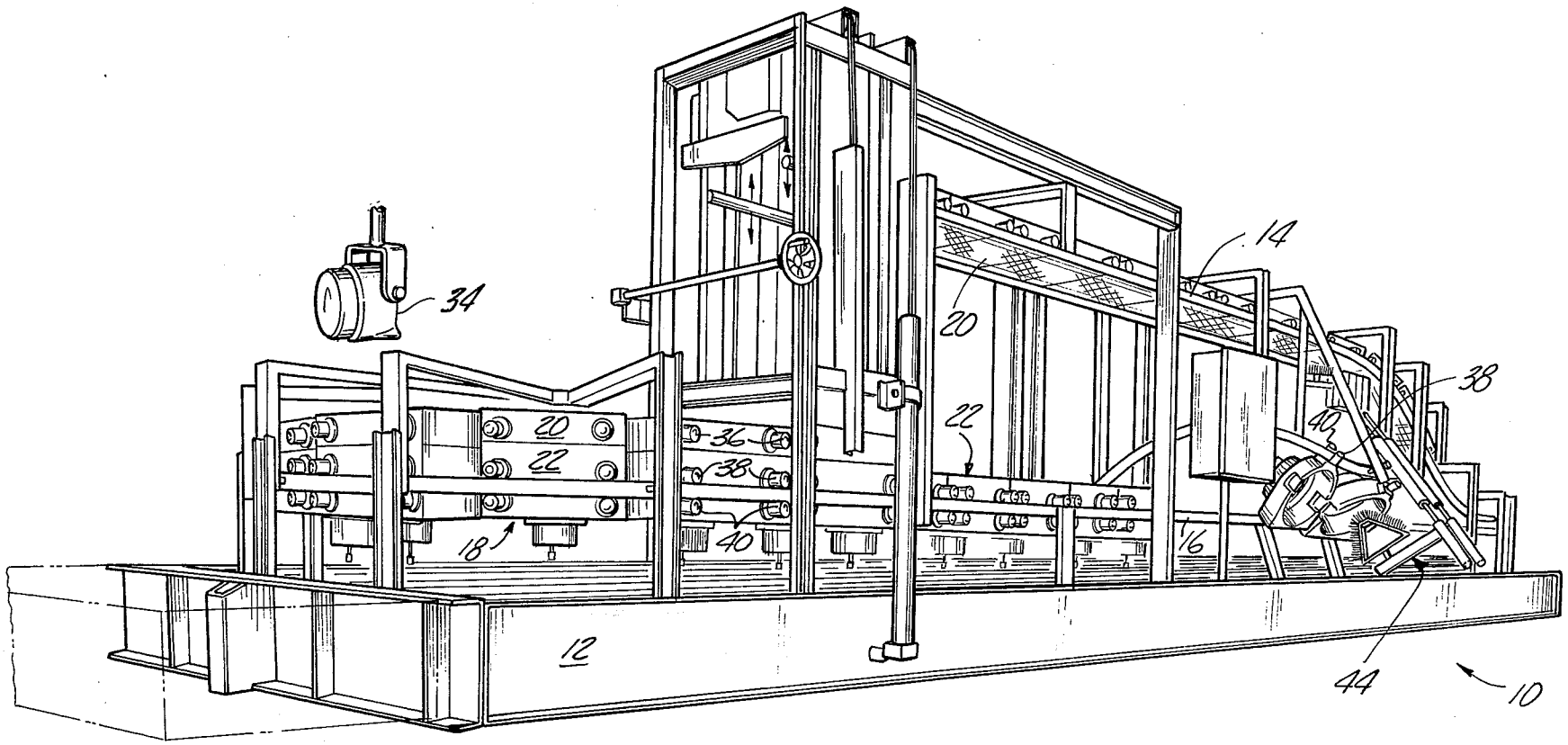
FIG. 1 is a front three-quarter perspective view of the cleaning, loading, assembly and pouring stations of the mechanical unit for handling the permanent mold blanks during a casting cycle.
Figure 2:
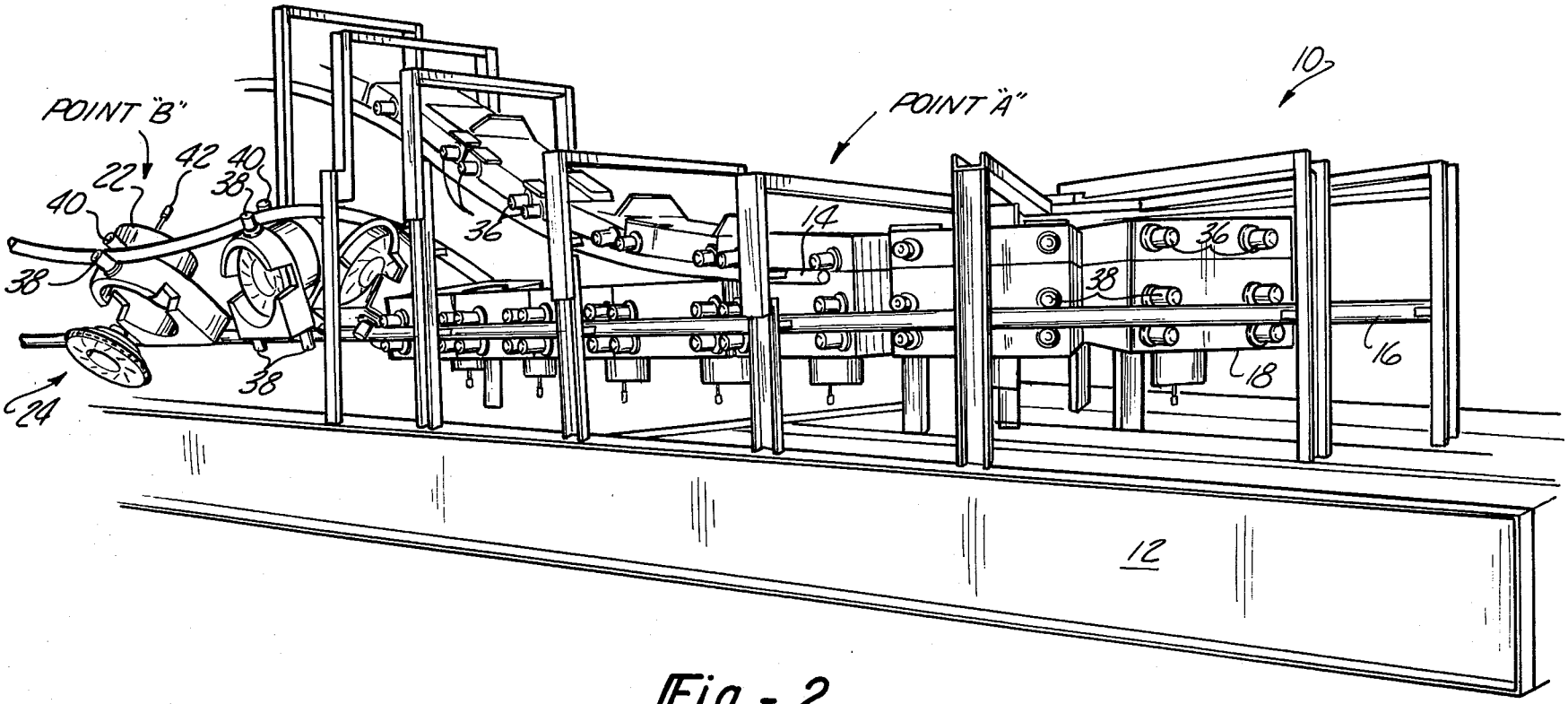
FIG. 2 is a rear three-quarter perspective view of the cooling, opening and unloading stations of the mechanical unit.

Referring now to the drawings, as best seen in FIGS. 1 and 2, the apparatus for metal casting indicated generally by the number 10 includes a base 12 for supporting the molding apparatus. The molding apparatus includes an upper track 14 and a lower track 16 for supporting a plurality of mold assemblies 18.

Figure 6:
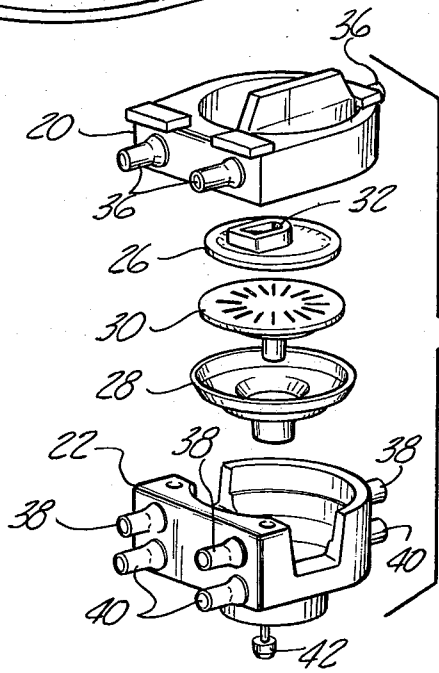
FIG. 6 is an exploded view of the mold assembly.

An individual mold assembly 18 is best seen in FIG. 6 and includes permanent mold support structure consisting of a cope 20 and drag 22. Positioned within the mold structure is a disstructible mold liner 24 consisting of an upper liner 26 and a lower liner 28 with a core 30 positioned there-between. The upper liner includes a pouring basin 32 for receiving the molten metal from the pouring ladle 34.

Extending from the mold structure are a plurality of supports arms for supporting the mold structure on the tracks 14, 16 as the mold is moved from station to station on the metal casting apparatus. In this particular embodiment the cope 20 has three supporting arms 36 and the drag 22 has three pair of supporting arms, the three upper arms designated as 38 and the three lower arms as 40.

Figure 3:
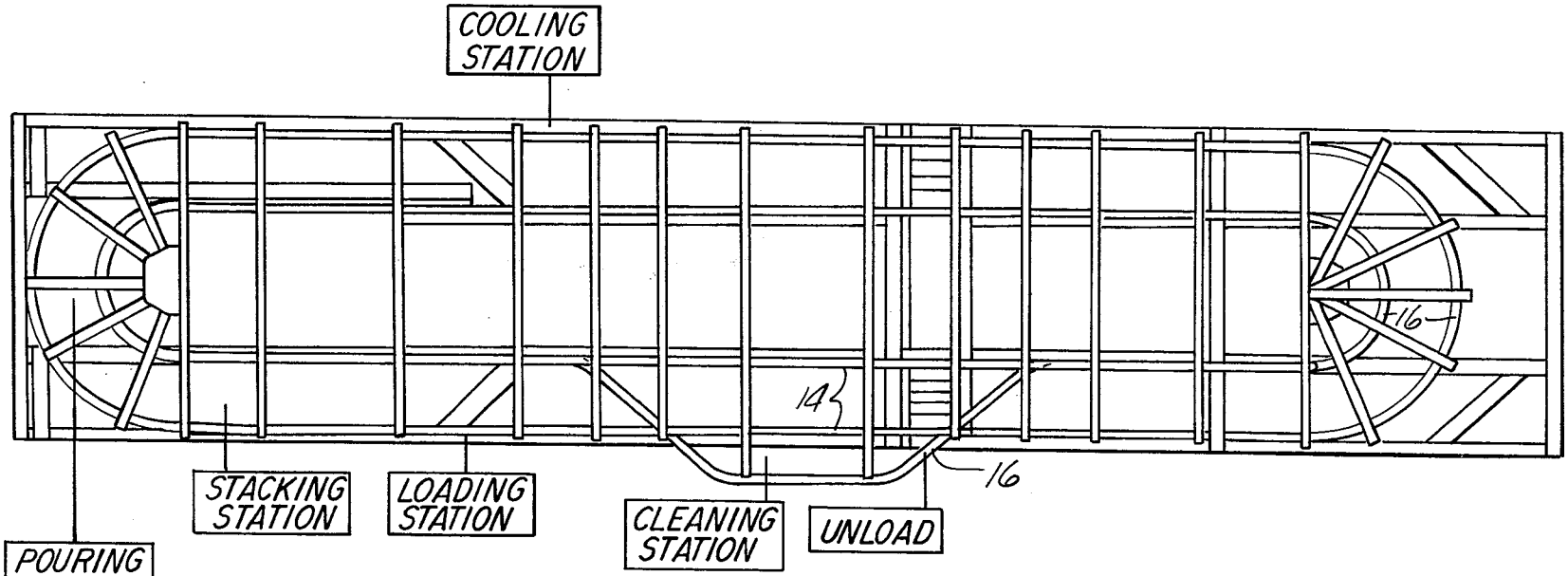
FIG. 3 is a plan view of the basic mechanical handling unit.
Figure 4:
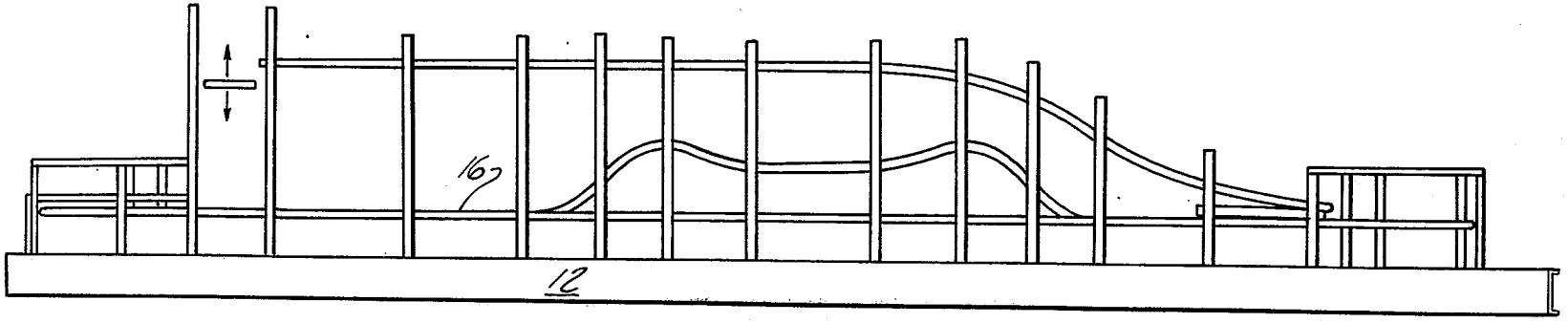
FIG. 4 is a front view of the basic mechanical handling unit.
Figure 5:
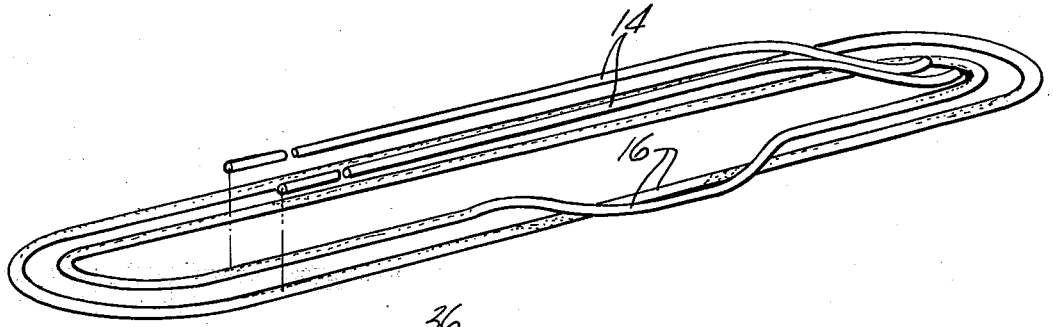
FIG. 5 is a perspective view of the supporting track for the molds.

In operation, the metal casting apparatus functions in the following manner, beginning at the pouring station, the assembled mold 18 supported on arm 38 is positioned beneath the pouring ladle 34 and filled with molten metal. The filled mold assembly 18 is then moved on lower track 16 to the Cooling Area (seen in FIG. 3). As the casting mold assembly moves along the cooling area, the casting solidifies. From the Cooling Area, as seen in FIG. 2, the mold assembly is moved to the Unloading Station where, at Point A, the support arms 36 engage the upper track 14 and as the mold assembly is moved along the divergent tracks 14, 16, the cope 20 is separated from the drag 22 containing the mold liner 24 and casting. As the drag 22 continues on lower track 16, the inner portion of track 16 is formed upwardly and outwardly of the outer portion of track 16 to invert the drag 22 supported on track 16 by arms 38 when in the inverted position so that the mold liner 24 and casting drop from the drag at Point B. An ejection rod 42 extends from the bottom of the liner cavity for use to eject the mold liner and casting should they stick in the drag.

After the mold liner and casting have been removed from the drag, a cleaner mechanism 44 cleans any remaining portions of the mold liner adhering to the cope or drag at the Cleaning Station.

Further movement of the drag along track 16 returns the drag to its original upright position at the Loading Station. The assembled mold liner 24 is placed in the cleaned liner cavity of the drag at the Loading Station and the drag continues to the Stacking Station.

At the Stacking Station, the cope 20 is removed from the upper track 14 and lowered by the stacking mechanism onto the drag 22, thereby securing the mold liner 24 therebetween and completing the mold assembly.

The mold assembly then moves to the Pouring Station for another cycle about the tracks.

Any of a number of commercially available power means may be utilized to move the mold assemblies 18 from station to station on the tracks 14, 16. The preferred method for moving the mold assemblies around this apparatus includes a drive means for engaging each drag 22 at the Stacking Station as the cope 20 is positioned thereon and maintaining engagement to the Pouring Station and then to the beginning of the Cooling Station. The mold assemblies 18 contact and push the assembly immediately ahead of it on the track so that as the drive means moves an assembly from the Pouring Station to the Cooling Station all the molds ahead of the last poured mold assembly are pushed along the track by the rear assembly.

Thus it can be seen that a mold line can be assembled on this novel apparatus and by changing the inner configuration of the mold liner, different pieces may be molded on the same line without changing the permanent mold structure. The same advantage could be utilized in manufacturing prototypes and experimental casting wherein the sand liners could be fabricated from wood or plastic models rather than more expensive metal models.

While this embodiment illustrates the apparatus needed for casting brake disks, modification of the apparatus within the general scope of the invention to accommodate other cast products would be obvious to one skilled in the art.

I claim:

1. A molten metal casting apparatus comprising support means, a lower continuous closed track mounted on said support means, an upper track portion aligned with said lower track and mounted on said support means above said lower track, a plurality of mold assemblies each mold assembly includes a cope, a drag matingly supporting said cope, said drag being supported on said lower track by a plurality of said support arms and said cope having a plurality of said support arm for cooperating with said upper track portion for removal of said cope for said drag, a cavity formed between said drag and said cope, an aperture in said cope extending between said cavity and the outer surface thereof, a destructible mold liner positioned and supported within said cavity having an outer surface matingly engaging and being supported by said cavity, said mold liner including a pouring basin extending through said aperture for receiving and conducting molten metal into said mold liner, and an inner cavity in said mold liner in communication with said pouring basin for receiving the molten metal and confining the molten metal until it solidifies, a plurality of support arms extending from each of said mold assemblies for mounting said mold assemblies on said tracks and cooperating therewith for movement there along, a plurality of stations along said tracks, means for moving said mold assemblies along said tracks to said stations, said stations including a loading station for placing a mold liner within each of said mold assemblies, a pouring station adjacent said assembly station for pouring molten metal within the mold liner, a cooling station adjacent said pouring station for holding the mold assemblies while the molten metal solidifies, an unloading station adjacent said cooling station for removing the mold liner with solidified casting from said mold assemblies, and a cleaning station positioned between said unloading station and said loading station for cleaning said mold assemblies.

2. The apparatus as claimed in claim 1 wherein an ejection rod is movably positioned in said drag having one end contacting said mold liner within said cavity and the other end being spaced from said drag, said ejection rod being longitudinally movable for movement into and out of said cavity whereby application of a force on said other end toward said cavity will apply a force to the mold liner by the one end of the ejector rod thereby loosening the mold liner from said cavity for ease of removal therefrom.

3. A molten metal casting apparatus comprising support means, a lower continuous closed track mounted on said support means, an upper track portion aligned with said lower track and mounted on said support means and extending upwardly above said lower track, a plurality of mold assemblies, consisting of copes positioned on drags a plurality of support arms extending from each of said mold assemblies said support arms of said cope engaging said upper track and said support arms of said drag engaging said lower track for mounting said mold assemblies on said tracks and cooperating therewith for movement there along, a mold liner for each mold assembly, a plurality of stations along said tracks, means for moving said mold assemblies along said tracks to said stations, said stations including a loading station for placing one of said mold liners within each of said mold assemblies, a pouring station adjacent said assembly station for pouring molten metal into said mold liner positioned in said mold assembly, a cooling station adjacent said pouring station for holding the mold assemblies while the molten metal solidifies, an unloading station adjacent said cooling station for separating the cope and drag and removing said mold liner with solidified casting from said mold assemblies, and a cleaning station positioned between said unloding station and said loading station for cleaning said mold assemblies.

* * * * *